United States Patent [19]

Detjen

[11] 4,216,555

[45] Aug. 12, 1980

[54] DUAL FLUSH SYSTEM

[76] Inventor: Edgar W. Detjen, Mueller Rd., Rte. 2, Kiel, Wis. 53042

[21] Appl. No.: 10,341

[22] Filed: Feb. 8, 1979

[51] Int. Cl.[2] ..... E03D 1/14; E03D 3/12

[52] U.S. Cl. ..... 4/324; 4/325; 4/415; 4/DIG. 1

[58] Field of Search ..... 4/381, 385, 394, 403, 4/325, 324, DIG. 1, 415

[56] References Cited

U.S. PATENT DOCUMENTS

| | | | |
|---|---|---|---|
| 2,532,977 | 12/1950 | White | 4/325 |
| 2,602,934 | 7/1952 | McCormack et al. | 4/324 |
| 2,645,780 | 7/1953 | Becker | 4/325 |
| 2,825,908 | 3/1958 | Tucker | 4/324 |
| 3,026,536 | 3/1962 | Wood | 4/324 |
| 3,108,286 | 10/1963 | Moore | 4/325 |
| 3,141,177 | 7/1964 | Kertell | 4/325 |
| 3,156,930 | 11/1964 | Moulton et al. | 4/325 |
| 3,538,519 | 11/1970 | Weisz | 4/325 |
| 3,561,016 | 2/1972 | Reynolds | 4/394 |
| 3,775,778 | 12/1973 | Lee | 4/325 |
| 3,787,902 | 1/1974 | McCombs | 4/325 |
| 3,936,889 | 2/1976 | Wibroe | 4/325 |
| 4,032,997 | 7/1977 | Phripp et al. | 4/415 |
| 4,038,708 | 8/1977 | Perrine et al. | 4/415 |

*Primary Examiner*—Henry K. Artis

*Attorney, Agent, or Firm*—Ralph G. Hohenfeldt

[57] ABSTRACT

A dual flush system tank adapted to provide either a full flush or a partial flush at the option of the user. The control handle is actuated normally to produce a full flush. If a partial flush is desired, the control handle is held in its depressed condition for two or three seconds after which it is released. This produces a partial flush. A partial flush is produced by a buoyant reseating weight which will float down with the falling level of liquid in the tank to depress the flush ball and prematurely reseat it in its outlet seat when only part of the liquid has been discharged from the tank. The reseating weight is provided with a latch actuated by the flush handle. For a full flush, the latch is released but is immediately re-engaged before the reseating weight moves downwardly in the tank and is hence latched against premature seating of the flush bal. However, for a partial flush when the flush lever is held down for a few seconds, the reseating weight floats down with the falling level of the liquid in the tank until it is out of range of the latch, so as to produce a partial flush.

11 Claims, 6 Drawing Figures

DUAL FLUSH SYSTEM

BACKGROUND OF THE INVENTION

Various prior art proposals have been made to modify toilet flush tanks to a dual flush system which can be actuated at the option of the user to produce either a full flush or a partial flush. Prior U.S. Pat. Nos. 2,532,977; 2,775,772; 2,825,908; 3,141,177; 3,026,536; 3,538,519; 3,561,014; 3,561,016; 3,787,902; 3,839,746 and 4,038,708 are examples thereof.

These prior art proposals are not entirely satisfactory because of the complexity of the apparatus or the awkwardness of the control handle manipulations which are required to make them function. These difficulties have inhibited the adoption and use of the prior art proposals. In some prior art proposals, such as in McCombs U.S. Pat. No. 3,787,902 and Kertell U.S. Pat. No. 3,141,177, the flush handle must be moved in different directions to produce a full or a partial flush. In other prior art proposals, such as White U.S. Pat. No. 2,532,977 and Weisz U.S. Pat. No. 3,538,519, there are two flush handles, one for a full flush and one for a partial flush. In other prior art proposals, such as Clarke U.S. Pat. No. 2,775,772; Tucker U.S. Pat. No. 2,825,908; Johnson U.S. Pat. No. 3,561,014; Reynolds U.S. Pat. No. 3,561,016; Kowalski U.S. Pat. No. 3,839,746 and Perrine U.S. Pat. No. 4,038,708 normal actuation of a single flush handle in which it is momentarily depressed and released produces a partial flush. An abnormal manipulation of the handle, such as holding it down for a time period is required to produce a full flush. Accordingly, those unfamiliar with the mechanism will typically manipulate the flush handle for a partial flush when they really want a full flush. In other prior art proposals, such as Kertell U.S. Pat. No. 3,141,177, the flush ball actuating apparatus has to be replaced by a new apparatus specifically designed to function with the dual flush system. The patent to Wood U.S. Pat. No. 3,026,536 does produce a full flush when using the mechanism in the normal manner in which the flush handle is depressed momentarily and released, but a second actuation of the flush handle is involved in producing a partial flush.

SUMMARY OF THE INVENTION

In accordance with the present invention, conversion of an existing flush tank from single to dual flush mechanism is accomplished with the minimum number of added parts. In use, a full flush is produced when using the mechanism in the normal and expected manner in which the flush lever is momentarily tripped and released. A partial flush is achieved by simply holding the flush handle in its tripped position for two or three seconds and then releasing it. These control manipulations are simple and easily remembered, and those unfamiliar with the system will automatically achieve a full flush by using the mechanism in the manner of an ordinary flush tank and without any prior training as to the manner in which the mechanism should be manipulated.

In accordance with the present invention, a buoyant flush ball reseating weight may float up and down with the level of liquid in the tank. In its uppermost position after the tank is filled, it is engaged by a latch which will hold it in its uppermost position. This latch is released by a trigger linked to the flush handle. For a normal flush, the flush handle is tripped by depressing it momentarily to unseat the flush ball. This also releases the latch for the reseating weight. However, the latch is re-engaged immediately because the flush handle is depressed only momentarily and latch re-engagement occurs before the level of liquid in the tank drops far enough to allow the reseating weight to descend out of range of the latch. Accordingly, the liquid level in the tank will drop, but the reseating weight will not drop with it because the re-engaged latch holds the reseating weight in its uppermost position.

For a partial flush, the operator will hold the flush handle in its depressed position for two or three seconds. This allows enough time for the liquid level in the tank to drop and carry with it the reseating weight until it is out of range of the latch. When the operator releases the flush lever, the latch will return to its normal position, but the reseating weight will be out of range thereof so that the latch will be ineffective to engage the reseating weight. Thereupon, the reseating weight will float down with the falling level of the liquid in the tank and will prematurely reseat the flush ball for a partial flush. The rising level of the liquid in the tank will then return the reseating weight to its uppermost position in which it will be engaged by the latch.

In preferred embodiments of the invention, the latch comprises coacting magnetic parts on the reseating weight and on the trigger.

The simple mechanism of the present invention can easily be applied to all commercial types of toilet tank flush mechanisms, incuding those having the flush ball mounted on a stem and those having the flush ball mounted on a flap hingedly connected to the standpipe.

Other objects, features, and advantages of the invention will appear from the disclosure hereof.

DESCRIPTION OF THE PREFERRED EMBODIMENTS

Figure 2:
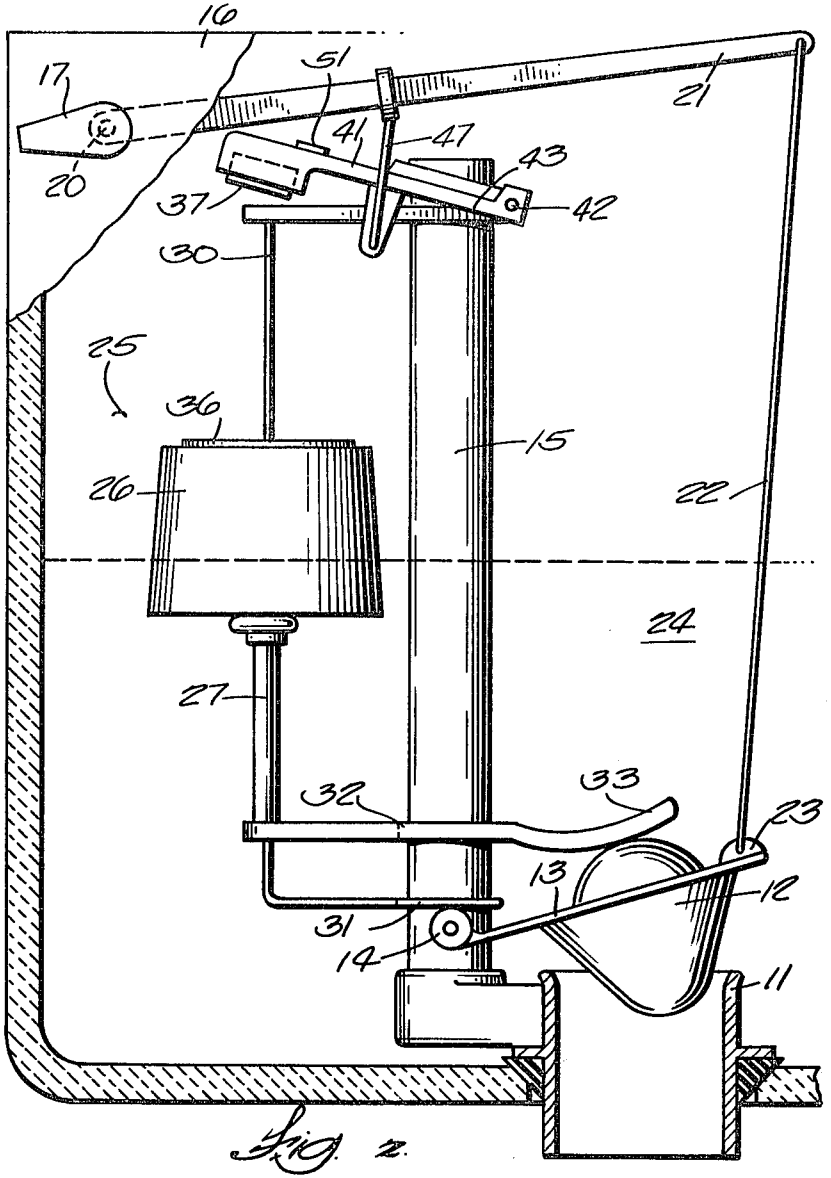
FIG. 2 is a fragmentary side elevation similar to FIG. 1 but showing the reseating weight released for a partial flush.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Like parts are given the same reference characters in the several views.

Figure 1:
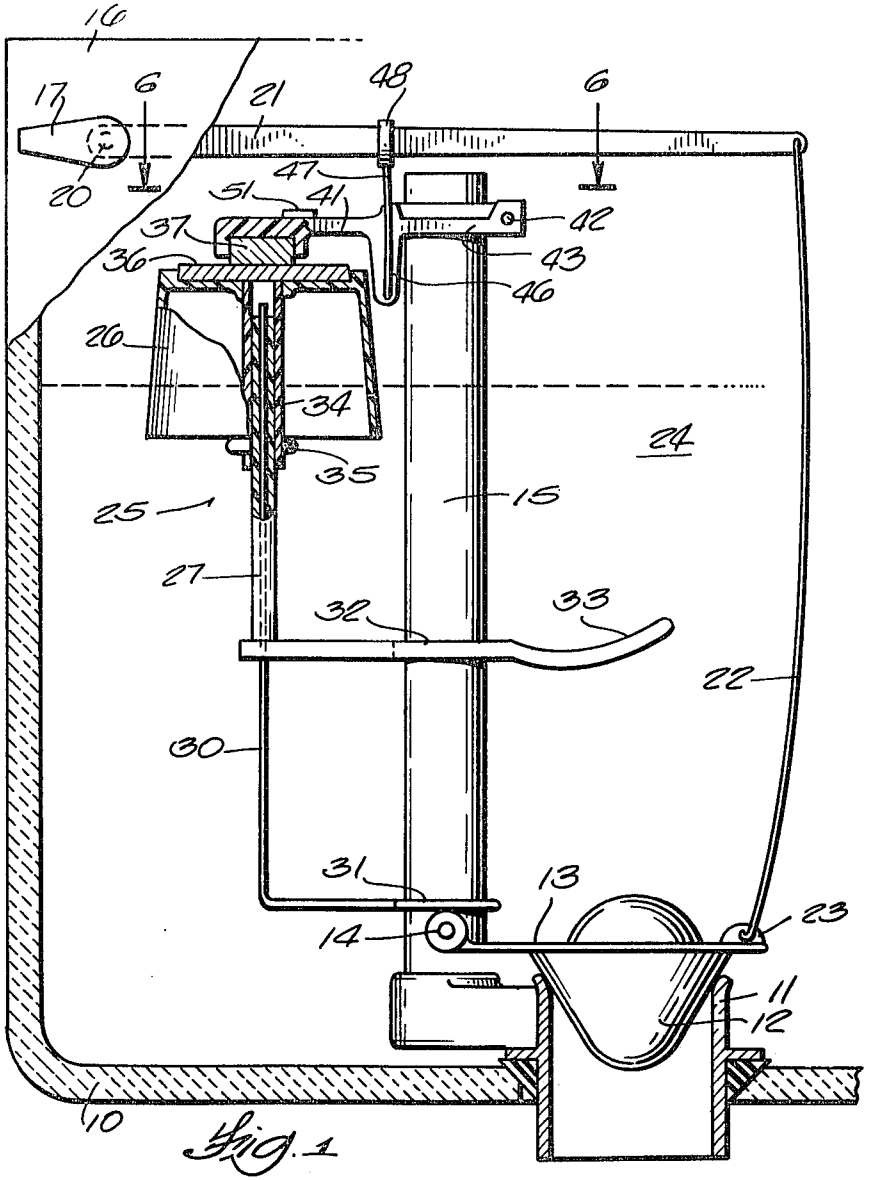
FIG. 1 is a fragmentary side view partly in cross section, showing apparatus embodying the present invention incorporated in a toilet flush tank in which the flush ball has a hinged flap and in which the reseating weight is in its uppermost position.

As shown in FIGS. 1 and 2, a typical toilet flush tank 10 has its flush outlet 11 normally closed by a flush ball 12 mounted on a resilient flexible flap 13 hinged about its connection 14 with the tank standpipe 15. Near the top of its side 16, the tank 10 is provided with a conventional flush handle 17 mounted on a pivot 20 from which a conventional flush lever 21 extends inside of the tank. The end of the lever 21 is provided with a chain or similar link 22 which connects with a suitable bracket 23 on the flush ball 12. When handle 17 is depressed to its position shown in FIG. 2, the lever 21 lifts the link 22 to unseat the flush ball 12 and allows liquid 24 in the tank to flush through the outlet 11.

The flush ball 12 is buoyant. Accordingly, as soon as it is unseated, its buoyancy will cause it to rise as far as it can, restrained only by the flap 13. Accordingly, flush ball 12 remains open until the liquid level in the tank drops low enough with respect to ball 12 so that gravity, any resilient bias on the flap 13 and water flow pressure will restore the ball to its seat 11. Liquid entering the tank will then fill the tank.

To adapt the tank for a dual flush system, a buoyant reseating weight, indicated generally by reference character 25, is provided. The reseating weight comprises an inverted cup-shaped float 26 having an internal axially extending tube 34 telescopically about and axially adjustable along a hollow stem 27 which rides telescopically on an upstanding guide rod 30 attached at its lower end by bracket 31 to the base of the standpipe 15. The upper end of guide rod 30 extends upwardly through the top of float 26 and is secured to standpipe bracket 43. At its lower end, the stem 27 is provided with a flush ball contact fork 32 which has fork tines 33 embracing the standpipe 15 and which function to depress the flush ball 12 for premature reseating thereof when the flush handle 17 is manipulated for a partial flush.

The relative telescopic position of tubes 27, 34 is adjustable to adjust the spacing between the float 26 and float ball reseating fork 32. Tubes 27, 34 are adjustably clamped together by the clamp ring 35. This will regulate the amount of liquid within the tank which is discharged in a partial flush manipulation thereof. At its top, the float 26 is provided with a magnetically responsive plate disk 36 which coacts with a magnet 37 mounted on a trigger arm 41 as hereinafter described. The magnetic plate 36 and a magnet 37 constitute coacting parts of a magnetic latch. If desired, non-magnetic latch mechanisms could be utilized in place of the magnetic latch herein disclosed.

Magnet 37 is attached to a trigger 41 which is pivotally connected on pintle 42 to standpipe bracket 43. The bracket 43 is releasably attached to the upper end of standpipe 15 by means of the pintle 42 which passes through the trigger 41 and through ends of bifurcated arms 44 of the bracket 43. The end of pintle 42 is held by a nut 45. Bracket 43 may be moved up and down on the standpipe for adjustment purposes and trigger 41 is free to pivot about pintle 42.

Figure 6:
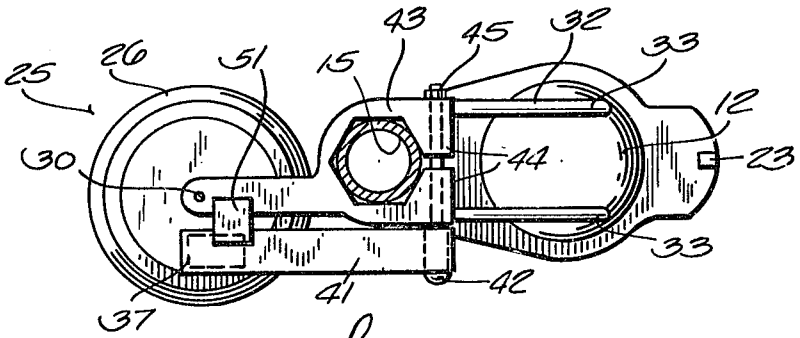
FIG. 6 is a cross section taken along the line 6—6 of FIG. 1.

Trigger 41 has an arm 46 to which one end of a chain or like link 47 is attached. The other end of the link 47 is attached by bracket 48 to the flush lever arm 21. Trigger 41 has a laterally projecting stop tab 51 which overhangs the bracket 43 and normally rests on its upper surface as shown in FIG. 6.

A full tank of liquid 24 is illustrated in FIG. 1. The buoyancy of the float 26 of the reseating weight 25 has lifted it to its uppermost position in which its metal plate 36 touches the magnet latch 37. To produce a full flush, the operator trips lever 17 by momentarily depressing it to its position shown in FIG. 2. This is the normal mode of manipulating the flush handle for a full flush. This manipulation will unseat the flush ball 12 which will remain open because of its buoyancy even after the link 22 becomes slack. At the same time, link 47 will lift the trigger 41 to its upwardly inclined position shown in FIG. 2, thus pulling the magnet 37 away from the plate 36 on the top of the float 26 and unlatching the reseating weight 25.

In the normal operation of the mechanism to produce a full flush, the operator will immediately release the lever 17 so that magnet 37 drops back to re-engage the metallic plate 36 on the top of the float 26 to relatch the reseating weight 25 in its uppermost position. This all occurs in the momentary manipulation of flush lever 17 and before the liquid level in the tank has a chance to fall. Thereafter, the liquid level in the tank will drop to its full extent for a full flush and until flush ball 12 closes. When the liquid level drops close to the upper end of the outlet 11, the weight of the flush ball 12, the resilient pressure of the resilient flap 13 and the fluid flow pressure of the flushing liquid will close the flush ball 12 against its seat on the outlet 11. The liquid level will then gradually rise to refill the tank as shown in FIG. 1. During this normal flush, the reseating weight 25 will remain in its uppermost position as held there by the latch 37, as shown in FIG. 1.

FIG. 2 illustrates utilization of this mechanism for a partial flush. The flush handle 17 is depressed to unlatch the reseating weight 25 and is held there for an abnormal time period of two or three seconds until the liquid in the tank has dropped and float 26 floats down with the dropping liquid level below the range of the magnet 37. Thereafter, release of the handle will restore the trigger 41 to its normal position in which its stop 51 engages the top of the bracket 43. However, by that time the float 26 has moved downwardly in the tank far enough to be out of range of the magnet. Reseating weight 25 will float down with the dropping level of liquid and the tines 33 of the fork 32 will engage the top of the flush ball 12 and depress the flush ball against its buoyancy and into reseated closed relationship to the outlet 11. At this point, there is still a substantial quantity of liquid 24 in the tank, as illustrated in FIG. 2, and a partial flush has been effected. Liquid will now refill the tank and lift the float 26 to its uppermost position where it will again come into range of the magnet 37 and be latched thereto.

Accordingly, a full flush is produced by the normal momentary actuation of the flush handle 17 and a partial flush is effectuated by an abnormal actuation of the handle 17 in which it is held in its depressed position for two or three seconds which is time enough for the liquid level in the tank to drop the float 26 out of range of the magnet 37.

Figure 3:
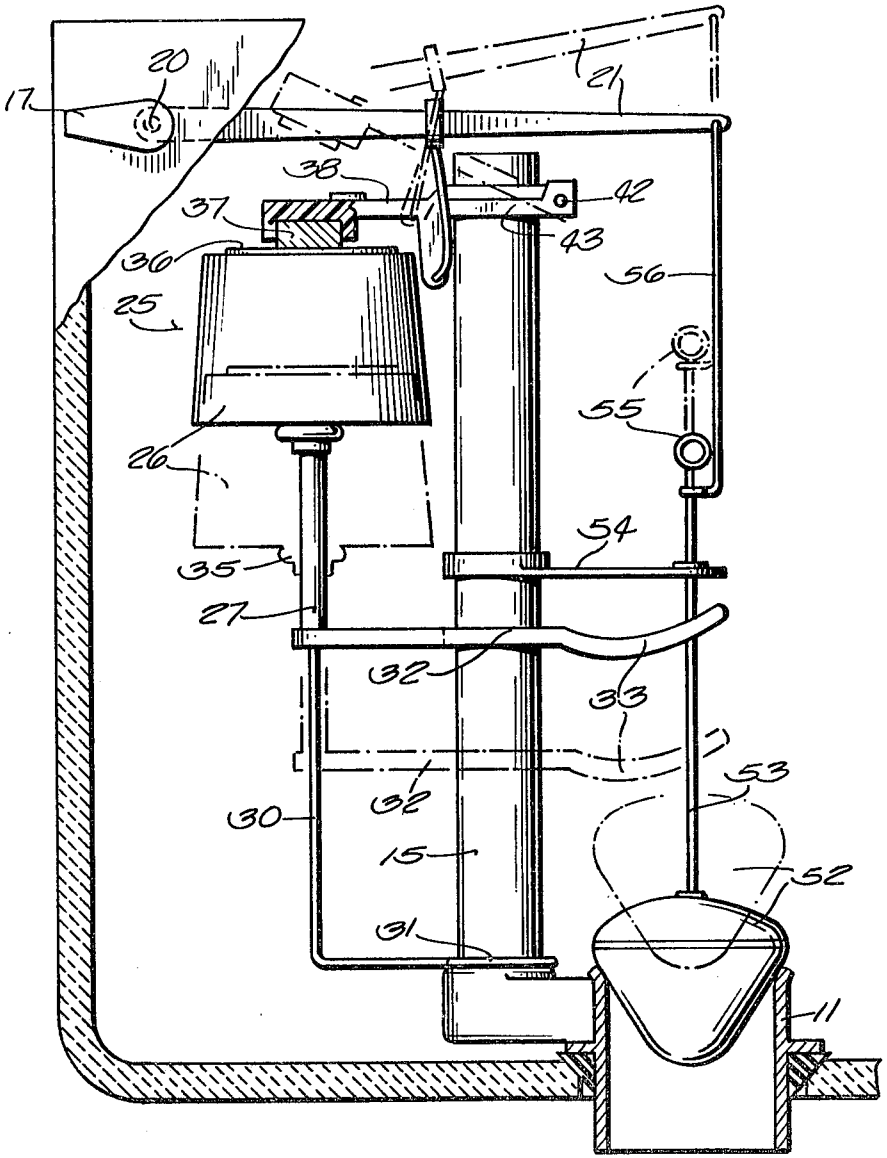
FIG. 3 is a fragmentary side elevation of apparatus embodying the invention as applied to a toilet flush tank having the flush ball mounted on a stem. Various positions of the parts are shown in full and broken lines.

FIG. 3 shows a modified embodiment in which flush ball 52 is mounted for vertical movement on a stem 53 which is guided on a bracket 54 secured to the standpipe 15. The upper end of the stem 53 is typically provided with an eye 55 and stem 53 is loosely coupled to lift link 56 which interconnects the stem 53 to the flush lever 21. The other parts shown in FIG. 3 are the same as previously described and are given the same reference characters. The operation of the mechanism shown in FIG. 3 is substantially identical to that described in connection with the operation of the embodiment shown in FIGS. 1 and 2. Bracket 54 does not interfere with vertical movement of the reseating weight 25 because float 26 is laterally offset therefrom.

From the foregoing, it is seen that the same reseating mechanism and latch therefor are used in all embodiments of FIGS. 1–3, inclusive. All parts of the flush tank, except the reseating weight 25, guide rod 30, latch 37 and standpipe bracket 43, are standard parts and only the reseating weight 25, guide rod 30, latch 37 and standpipe bracket 43 need be added to the flush tank to adapt it to partial flush operation.

Figure 5:
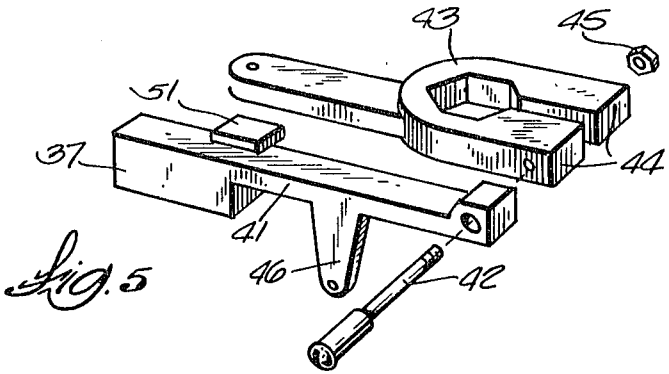
FIG. 5 is a fragmentary perspective view showing a standpipe bracket and reseating weight trigger utilized in the embodiments of the invention shown in FIGS. 1–3.
Figure 4:
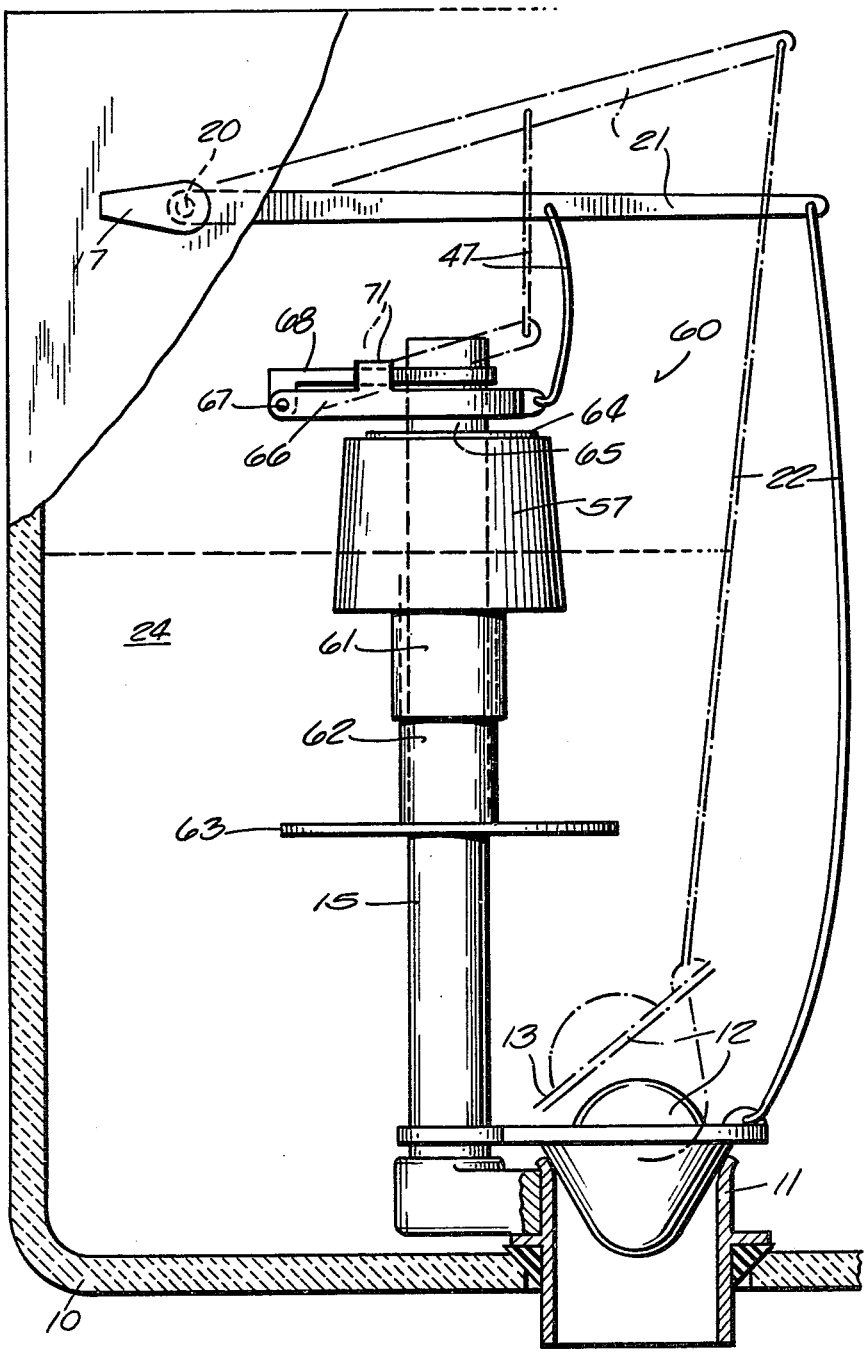
FIG. 4 is a fragmentary side elevation of a modified embodiment of the invention in which the reseating weight is guided for vertical movement on the standpipe.

Another modified embodiment of the invention is shown in FIG. 4. In this embodiment, the flush ball 12 is mounted on a flap 13, as in FIGS. 1 and 2. Accordingly, in this type of construction there is no need for a bracket such as 54 of FIG. 3. Accordingly, the standpipe 14 is free of any obstructions and can be utilized as a guide for a reseating weight 60. In this embodiment, reseating weight 60 comprises a float 57 having downwardly projecting tube 61 in telescopically adjustable relationship to a tube 62 on a disk-shaped flush ball contactor plate 63. The top surface of the float 57 is provided with a magnet plate 64 which engages the magnet 65 on a trigger 66 which is pivotally connected by pintle 67 to a bracket 68 adjustably mounted on the standpipe 15. As in the previously described embodiments of the invention, link 47 interconnects the trigger to the flush lever 21. Trigger arm 66 has an overhanging stop tab 71, similar to stop tab 51 in the previously described embodiments, and which engages the upper surface of the bracket 68 to keep the trigger arm 66 from dropping below its normal position as shown in FIG. 5. The operation of this embodiment is the same as in those previously described.

While the invention is illustrated in connection with a toilet flush tank, it can also be utilized in other flush tanks.

Another advantage of the invention is to prevent overflow of a toilet bowl during a full flush if the toilet bowl is plugged. By simply tripping the flush handle, the latch will be released to drop the reseating weight against the flush ball to reseat the ball and discontinue the flush before overflow occurs.

What is claimed is:

1. In a flush tank having an outlet with a valve seat, a buoyant flush ball valve for said outlet seat, a flush trip handle, a link between the flush ball and handle for lifting the flush ball off of the outlet seat, a buoyant flush ball reseating weight and guide means on which said reseating weight rises and falls with the level of liquid in the tank, said reseating weight prematurely closing the flush ball against its outlet seat to effectuate a partial flush when the reseating weight is allowed to float downwardly with the falling level of liquid in the tank, the improvement for actuating the flush ball reseating weight comprising:

(a) a movable member that is movable in response to tripping of said trip handle and is in magnetically coupled relation with said reseating weight for attracting and latching it in its uppermost position and holding it against downward movement toward the flush ball when the trip handle is momentarily tripped, whereby to produce a full flush, (b) mainintaining said trip handle in tripped condition for longer than momentarily such as for a few seconds permitting said weight to float down with the falling level of liquid in the tank a sufficient amount to effect magnetic uncoupling of said member and weight for enabling said weight to continue to float down and reseat the flush ball, whereby to produce a partial flush.

2. The invention of claim 1 in which said member is a permanent magnet and said reseating weight is magnetically susceptible and said magnet engages the reseating weight when the reseating weight is in its uppermost position and said member is out of range for exerting magnetic influence on the reseating weight when the reseating weight is below its uppermost position.

3. The invention of claim 2 in combination with a latch trigger which disengages said member from said weight when the trip lever is actuated and re-engages said latch if the trip lever actuation is only momentary and before the reseating weight moves downwardly out of range of said member.

4. The invention of claim 3 in which there is a link between the latch trigger and the flush trip handle.

5. The invention of claim 1 in which said flush tank further comprises a standpipe, said guide means comprising bracket means connected to the standpipe.

6. The invention of claim 1 in which said guide means comprises a standpipe for the flush tank.

7. The invention of claim 1 in which the buoyant flush ball reseating weight comprises a float element and a flush ball contacting element connected to the float element.

8. The invention of claim 7 in which said float element and ball contacting element are connected with means for making an adjustable connection between the ball contact and the float whereby the spacing between said float element and contacting element is adjustable to determine when said contacting element will act on said flush ball and thereby regulate the quantity of said partial flush.

9. In a flush tank having an outlet with a valve seat, a buoyant flush ball valve for said outlet seat, a flush trip handle, a link between the flush ball and handle for lifting the flush ball off of the outlet seat, a buoyant flush ball reseating weight and guide means on which said reseating weight rises and falls with the level of liquid in the tank, said reseating weight prematurely closing the flush ball against its outlet seat to effectuate a partial flush when the reseating weight is allowed to float downwardly with the falling level of liquid in the tank, the improvement for actuating the flush ball reseating weight and comprising a magnet latch near the top of the tank, said reseating weight and latch having magnetically responsive parts whereby the reseating weight will be normally latched in the uppermost position of the reseating weight, said latch comprising a trigger and a link between the tirgger and the flush handle whereby the trigger is actuated and the latch is released by manipulation of the flush handle.

10. The invention of claim 10 in which normal manipulation of the flush handle in which it is momentarily tripped relatches the latch before the reseating weight drops out of range of the magnet whereby to restrain said reseating weight from prematurely closing the flush ball and produce a full flush.

11. The invention of claim 10 in which abnormal manipulation of the flush handle in which it is depressed for a few seconds before it is released allows time for the reseating weight to drop out of range of the magnet to permit the reseating weight to prematurely close the flush ball and produce a partial flush.

* * * * *

UNITED STATES PATENT AND TRADEMARK OFFICE

CERTIFICATE OF CORRECTION

PATENT NO. : 4,216,555

DATED : August 12, 1980

INVENTOR(S) : Edgar W. Detjen

It is certified that error appears in the above-identified patent and that said Letters Patent are hereby corrected as shown below:

Column 5, Line 64, "mainintaing" should read --maintaining--

Column 6, Line 53, "tirrger" should read --trigger--

Column 6, Line 56, "claim 10" should read --claim 9--

Column 6, Line 63, "claim 10" should read --claim 9--

Signed and Sealed this

*Twenty-fifth* Day of *November 1980*

[SEAL]

*Attest:*

SIDNEY A. DIAMOND

*Attesting Officer*

*Commissioner of Patents and Trademarks*